US005875740A

United States Patent [19]

Ban et al.

[11] Patent Number: 5,875,740

[45] Date of Patent: Mar. 2, 1999

[54] VISCOUS FLUID TYPE HEAT GENERATOR WITH VARIABLE HEAT-GENERATING PERFORMANCE

[75] Inventors: Takashi Ban; Kenji Takenaka; Hidefumi Mori, all of Kariya, Japan

[73] Assignee: Kabushiki Kaisha Toyoda Jidoshokki Seisakusho, Kariya, Japan

[21] Appl. No.: 813,804

[22] Filed: Mar. 6, 1997

[30] Foreign Application Priority Data

Mar. 14, 1996 [JP] Japan ..... 8-057256

[51] Int. Cl.[6] ..... F22B 3/06

[52] U.S. Cl. ..... 122/26; 237/12.3 R; 126/247; 123/142.5 R

[58] Field of Search ..... 237/12.3 R, 12.3 B; 122/26; 126/247

[56] References Cited

U.S. PATENT DOCUMENTS 4,993,377 2/1991 Itakura ..... 123/142.1 R 5,007,303 4/1991 Okuzumi ..... 74/573 F

FOREIGN PATENT DOCUMENTS 2619206 8/1987 France .

JUA398107 10/1991 Japan .

*Primary Examiner*—Henry Bennett

*Assistant Examiner*—Derek S. Boles

*Attorney, Agent, or Firm*—Burgess, Ryan & Wayne

[57] ABSTRACT

A variable heat-generating performance viscous fluid type heat generator having a heating chamber in which an electrorheological fluid is confined to generate heat upon being subjected to a shearing action by the rotation of a rotor element within the heating chamber, a heat receiving chamber arranged adjacent to the heating chamber and permitting a heat exchanging liquid to receive heat from the electrorheological fluid and to circulate through the heat receiving chamber and an external heating circuit, and a controllable electricity conducting unit adjustably conducting electricity through the electrorheological fluid so as to adjustably change the viscosity of the electrorheological fluid to thereby vary the heat-generating performance of the viscous fluid type heat generator.

9 Claims, 3 Drawing Sheets

VISCOUS FLUID TYPE HEAT GENERATOR WITH VARIABLE HEAT-GENERATING PERFORMANCE

BACKGROUND OF THE INVENTION

1. Field of the Invention

The present invention relates generally to a viscous fluid type heat generator with variable heat-generating performance. More particularly, the present invention relates to a variable heat-generating performance viscous fluid type heat generator having an overall size reduced for enabling the heat generator to be easily mounted on a preselected mounting area in the body of an automobile.

2. Description of the Related Art

Japanese Unexamined Utility Model Publication (Kokai) No. 3-98107 discloses an automobile heating apparatus in which a viscous fluid type heat generator is incorporated. The viscous fluid type heat generator described in Japanese Unexamined Utility Model Publication (Kokai) No. 3-98107 includes a pair of mutually opposing front and rear housings tightly secured together by appropriate tightening elements such as through bolts to define an inner heat generating chamber and a heat receiving chamber separated by a partition wall through which the heat is exchanged between the viscous fluid in the heat generating chamber and the water in the heat receiving chamber. The heat receiving chamber is therefore arranged to be located outside but in close relation with the heat generating chamber. The heat exchanging water is introduced into the heat receiving chamber through a water inlet port and delivered from the heat receiving chamber toward an external heating system, and the water is constantly circulated through the heat generator and the external heating system.

A drive shaft is rotatably supported in the front housing via an anti-friction bearing so as to support thereon a rotor element in such a manner that the rotor element is rotated with the drive shaft within the heat generating chamber. The rotor element has outer faces which are face-to-face with the wall faces of the heat generating chamber and form labyrinth grooves therebetween, and a viscous fluid, for example, silicone oil is supplied into the heat generating chamber so as to fill the labyrinth grooves between the rotor and the wall faces of the heating chamber.

The automobile heating apparatus is further provided with a heat generating controller including a pair of engaged upper and lower covers defining therein a chamber in which a diaphragm element is received to form a part of the chamber as a controlling chamber enclosed by the diaphragm and the upper cover. The heat generating controller is attached to the lowermost portion of the front and rear housings. The controlling chamber of the heat generating controller fluidly communicates with the heat generating chamber via a fluid conduit, and the heat generating chamber in turn communicates with the atmosphere via an appropriate air hole formed in a connecting portion of the front and rear housings. The diaphragm of the heat generating chamber functions to adjustably change an internal volume of the controlling chamber in response to a vacuum pressure in the manifold of an automobile engine and a spring force of a coil spring arranged in a portion of the chamber of the heat generating chamber opposite to the controlling chamber.

When the viscous fluid type heat generator is incorporated in the heating system of an automobile, the heat generator per se is accommodated in a mounting space extending around an engine crank shaft so as to be operatively connected to the automobile engine. Therefore, the drive shaft of the viscous fluid type heat generator is rotated to rotate the rotor element within the heat generating chamber while applying a shearing action to the viscous fluid in the heating chamber. Thus, the viscous fluid generates heat when being sheared, and heat exchanging is conducted between the viscous liquid within the heat generating chamber and the water flowing through the heat receiving chamber. The heated water is circulated through the heating system of the automobile so as to warm the compartment within the automobile.

In the above-described conventional variable heat-generating performance viscous fluid type heat generator of Japanese Unexamined Utility Model Publication (Kokai) No. 3-98107, controlling of heat generation is conducted by a method described below.

Namely, when heat supply to the compartment of the automobile is excessive, the diaphragm of the heat generating controller is moved within the chamber of the upper and lower covers by the vacuum pressure of the engine manifold to increase the internal volume of the controlling chamber. Accordingly, the viscous fluid in the heat generating chamber is received by the controlling chamber of the heat generating controller. Therefore, heat generation within the heat generating chamber of the viscous fluid type heat generator is reduced due to reduction in the amount of the viscous fluid held between the inner wall of the heat generating chamber and the surface of the rotor element. As a result, supply of heat to the compartment within the automobile is reduced to lower a temperature in the compartment.

On the contrary, when the heat supply is excessively small, the diaphragm of the heat generating controller is moved within the chamber of the upper and lower covers to reduce the volume of the controlling chamber by the action of the spring force of the coil spring and an adjusting pressure supplied from a pressure adjusting hole formed in a part of the lower cover of the heat generating controller. Accordingly, the viscous fluid flows from the controlling chamber into the heat generating chamber of the viscous fluid type heat generator. Therefore, an increase in the amount of the viscous fluid held between the inner wall of the heat generating chamber and the surface of the rotor element of the heat generator is achieved so as to increase heat generation within the heat generating chamber. As a result, heat supply from the viscous fluid type heat generator to the compartment of the automobile is increased permitting the temperature within the compartment to go up.

Nevertheless, in the above-described variable heat-generating performance viscous fluid type heat generator, a separate heat-generating performance controller having a fluid receivable controlling chamber communicating with the heating chamber of the viscous fluid type heat generator must be arranged outside the heat generator to adjustably change the amount of viscous fluid held within the heat generating chamber of the heat generator to thereby control the heat-generating performance of the viscous type heat generator. Accordingly, an entire assembly of the viscous fluid type heat generator and the heat-generating performance controller becomes inevitably large in size resulting in making it difficult to mount the assembly in the body of the automobile.

SUMMARY OF THE INVENTION

Accordingly, an object of the present invention is to provide a variable heat-generating performance viscous fluid type heat generator which is capable of obviating the problems encountered by the convention assembly of a viscous fluid type heat generator and a heat-generating performance controller.

Another object of the present invention is to provide a smaller variable heat-generating performance viscous fluid type heat generator which can be easily mounted in a rather small mounting area of an automobile.

A further object of the present invention is to provide a variable heat-generating performance viscous fluid type heat generator of which the heating-performance can be controlled by a novel method.

In accordance with one aspect of the present invention, there is provided a viscous fluid type heat generator comprising:

a housing assembly defining therein, a heat generating chamber in which heat is generated, and a heat receiving chamber arranged adjacent to the heat generating chamber for permitting a heat exchanging fluid to circulate therethrough to thereby receive heat from the heating chamber;

a drive shaft supported, via a bearing device, by the housing assembly to be rotatable about an axis of rotation thereof;

a rotor element mounted on the drive shaft for rotation together therewith in the heat generating chamber;

a viscous fluid, filling up a space between ain inner surface of the housing assembly defining the heating chamber and an outer surface of the rotor element, for heat generation by the rotation of the rotor element, the viscous fluid being an electrorheological fluid; and a controllable electricity conducting unit for adjustably applying electricity to the electrorheological fluid to thereby adjustably change an apparent viscosity of the electrorheological fluid, the controllable electricity conducting unit being electrically connected to an electric power source.

It is well known to use the electrorheological fluid with vibration controllers, shock absorbers, and diverse kind of dampers. For example, one of the theses of the Mechanical Engineering Society of Japan under the title of "the Ninth Advanced Tribology Special Committee Document" addressed in the symposium held on Sep. 9, 1991, discloses various applications of the electrorheological fluid to vibration control devices. Nevertheless, it was previously unknown that the electrorheological fluid can be used with a viscous fluid type heat generator.

Preferably, the electrorheological fluid used with the above-mentioned viscous fluid type heat generator may be a silicone oil forming a dispersion medium suspending therein silicagel as a disperse phase.

Alternatively, the electrorheological fluid may be a silicone oil forming a dispersion medium having suspended therein aluminum silicate as a disperse phase.

Preferably, the controllable electricity conducting unit includes at least a pair of electrodes arranged in the heat generating chamber to be opposite to one another. Each of the electrodes is attached to each of a pair of opposite inner walls of the heating chamber.

Further, the controllable electricity conducting unit may include a switching unit operable to turn on and off the electricity applied to the electrorheological fluid within the heating chamber by the pair of electrodes so as to change the viscosity of the electrorheological fluid whereby the heating-performance of the heat generator is changed.

Alternatively, the controllable electricity conducting unit may include an electric field changing unit operable to change an electric D.C. voltage applied to the pair of electrodes to thereby change an electric field applied to the electrorheological fluid within the heating chamber.

In the above-described variable heat-generating performance viscous fluid type heat generator, when an increase in heat generation is needed for warming a predetermined heated area such as a passenger cabin of an automobile, the conduction of the electricity is adjusted in such a manner that either electric current is applied to or an increased electric field charges the electrorheological fluid so as to increase apparent viscosity of the fluid to be subjected to shearing action by the rotor. As a result, heat generating-performance of the heat generator can be increased.

When a reduction in heat to warm up the heated area is needed, the conduction of the electricity is controlled so that either the application of the electric current to the electrorheological fluid is stopped or the electric field charging the electrorheological fluid is reduced, the viscosity of the electrorheological fluid is apparently reduced. As a result, the heat generating-performance of the viscous fluid type heat generator can be lowered.

In accordance with another aspect of the present invention, there is provided a method of controlling heat-generation performance of a variable heating-performance viscous fluid type heat generator including a housing assembly defining therein, a heating chamber in which heat is generated, and a heat receiving chamber arranged adjacent to the heating chamber for permitting a heat exchanging fluid circulates therethrough to thereby receive heat from the heating chamber; a drive shaft supported, via a bearing device, by the housing assembly to be rotatable about an axis of rotation thereof; a rotor element mounted on the drive shaft for rotation together in the heating chamber; and a viscous fluid consisting of an electrorheological fluid, and filling up a space between an inner surface of the housing assembly defining the heating chamber and an outer surface of the rotor element, for heat generation by the rotation of the rotor element, the viscous fluid being an electrorheological fluid and arranged to be supplied with a controllable electricity from outside the heat generator, wherein the method includes adjustably changing the electricity applied to the electrorheological fluid by turning on and off the supply of an electric D.C. current to the electrorheological fluid in response to a change in a requirement for heat to be transmitted to the heat exchanging fluid circulating through the heat receiving chamber.

In accordance with a further aspect of the present invention, there is provided a method of controlling heat-generation performance of a variable heat-generating performance viscous fluid type heat generator including a housing assembly defining therein, a heating chamber in which heat is generated, and a heat receiving chamber arranged adjacent to the heating chamber for permitting a heat exchanging fluid to circulate therethrough to thereby receive heat from the heating chamber; a drive shaft supported, via a bearing device, by the housing assembly to be rotatable about an axis of rotation thereof; a rotor element mounted on the drive shaft for rotation together in the heating chamber; and a viscous fluid consisting of an electrorheological fluid, and filling up a space between an inner wall of the housing assembly defining the heating chamber and an outer surface of the rotor element, for heat generation by the rotation of the rotor element, the viscous fluid being an electrorheological fluid and arranged to be supplied with a controllable electricity from outside the heat generator, wherein the method includes adjustably changing the electricity applied to the electrorheological fluid by controlling an intensity of an electric field applied to the electrorheological fluid.

BRIEF DESCRIPTION OF THE DRAWINGS

The above and other objects, features, and advantages of the present invention will be made more apparent from the ensuing description of preferred embodiments thereof, in conjunction with the accompanying drawings wherein:

FIG. 3 is a partial cross-sectional view of a heating chamber provided in the heating generator of FIG. 1, illustrating a state in which the electricity applied to the electrorheological fluid within the heating chamber is turned ON.

DESCRIPTION OF PREFERRED EMBODIMENTS

Figure 1:
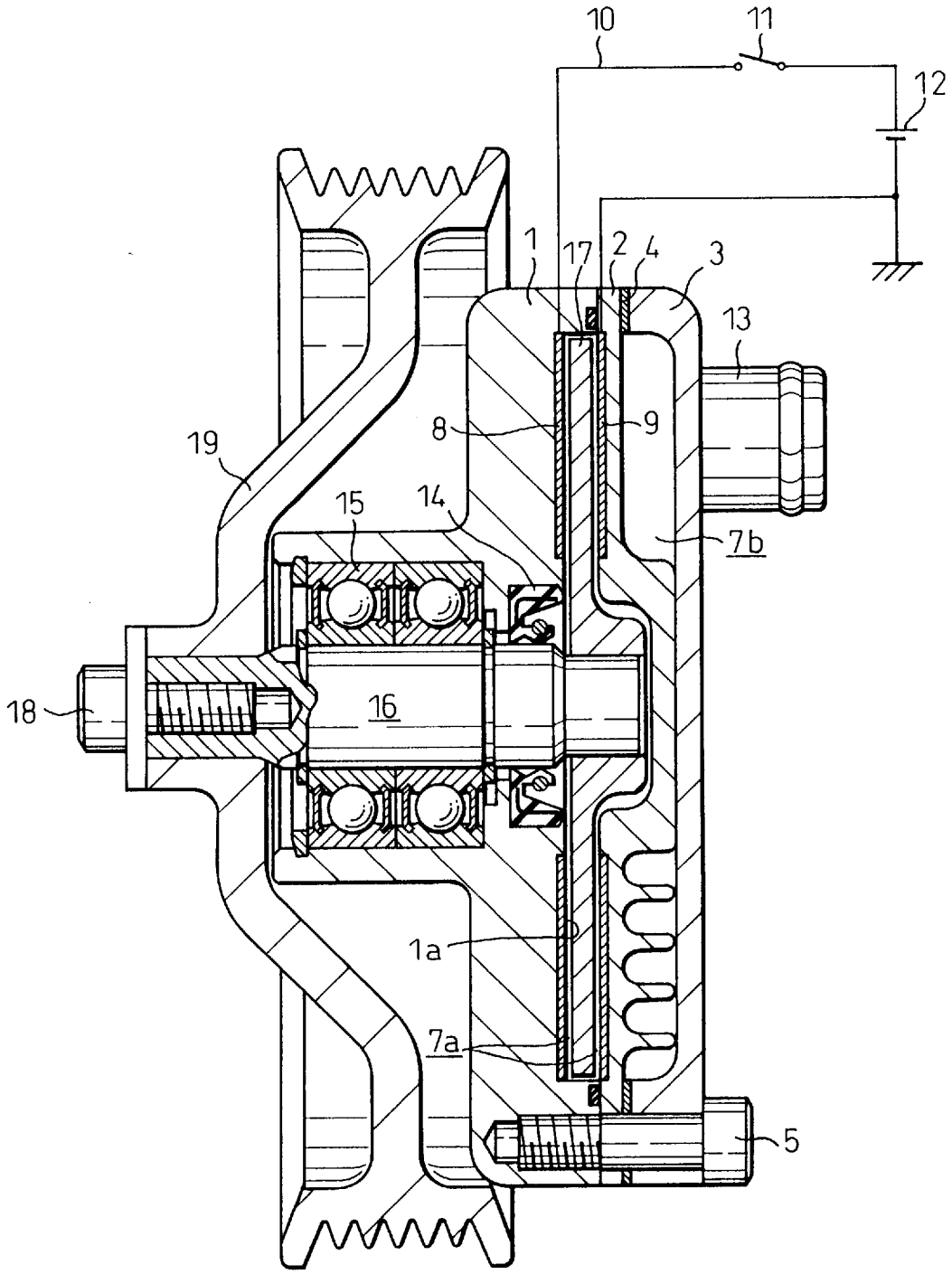
FIG. 1 is a cross-sectional side elevation of a variable heat-generating performance viscous fluid type heat generator according to an embodiment of the present invention.
Figure 2:
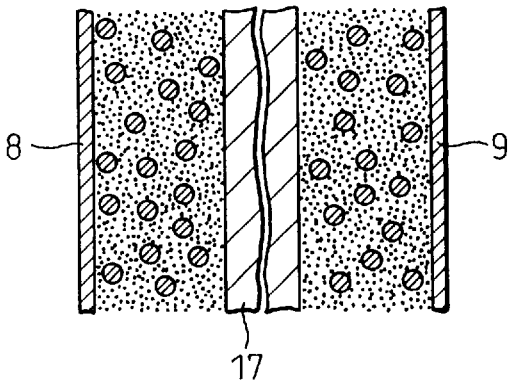
FIG. 2 is a partial cross-sectional view of a heating chamber provided in the heating generator of FIG. 1, illustrating a state in which the electricity applied to the electrorheological fluid within the heating chamber is turned OFF.
Figure 3:
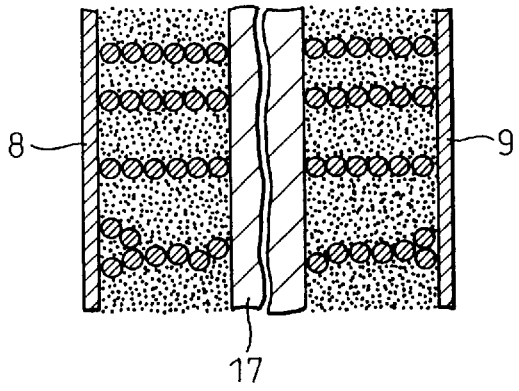

Referring to FIGS. 1 through 3, a variable heat-generating performance viscous fluid type heat generator has a housing assembly including a front housing body 1, a rear plate 2, and a rear housing body 3 which are arranged in a juxtaposition and combined together by a plurality of screw bolts 5. A gasket element 4 is interposed between the rear plate 2 and the rear housing body 3 so as to hermetically seal a connecting portion therebetween. The housing assembly has a front side (i.e., a left side in FIG. 1) and a rear side (i.e., a right side in FIG. 1). The front housing body 1 is provided with an inner end face in which an annular recess la is formed so as to cooperate with an inner end face of the rear plate 2 in defining a heating chamber 7*a*. The inner end face of the front housing body 1 and the inner end face of the rear plate 2 axially oppose one another via the heating chamber 7*a*. An electrode plate 8 is fixed to an inner face of the recess la of the front housing body 1, and an electrode plate 9 is fixed to the inner end face of the rear plate 2. The electrode plates 8 and 9 are made of an annular copper plate or a copper alloy plate, respectively, and are electrically connected to an outer electric power source (i.e., a battery 12) arranged outside the housing assembly by an appropriate electric lead 10. Namely, the electrode plate 8 of the front housing body 1 is connected to the positive electrode of the battery 12 by the electric lead 10 via a switch 11, and the electrode plate 9 of the rear plate 2 is connected to the grounded negative electrode of the battery 12 by the electric lead 10. The two electrode plates 8 and 9, the electric lead 10, and the electric switch 11 constitutes a controllable electricity conducting unit incorporated in the viscous fluid type heat generator of the present embodiment.

The afore-mentioned housing assembly also has a heat receiving chamber 7*b* defined between the other end face of the rear plate 2 and an inner end face of the rear housing body 3. The heat receiving chamber 7*b* is arranged adjacent to the above-mentioned heating chamber 7*a*. The rear housing body 3 is provided with an outer projection forming an inlet port 13 through which a heat exchanging liquid is introduced into the heat receiving chamber 7*b*. The heat exchanging liquid is delivered from the heat receiving chamber 7*b* into an external liquid line through an outlet port (not shown in FIG. 1) formed in the rear housing body 3. The heat exchanging liquid may be water.

The front housing body 1 of the housing assembly is provided with a central bore portion formed adjacent to the heating chamber 7*a* so as to receive a shaft sealing device 14. A cylindrical front boss portion of the front housing body 1 is formed as a hollow projection in which a pair of antifriction ball bearing devices 15 are disposed in order to rotatably support an axial drive shaft 16 having an inner end projecting into the heating chamber 7*a* via the shaft sealing device 14. Namely, the shaft sealing device 14 seals the circumference of the inner end of the drive shaft 16 at a position adjacent to the ball bearings 15, and the inner end of the drive shaft 16 supports thereon a disk-like rotor element 17 at the innermost portion thereof so that the rotor element 17 is located within the heating chamber 7*a* and rotates together with the drive shaft 16.

The heating chamber 7*a* of the housing assembly is filled with a viscous liquid which is electrorheological fluid. Namely, the electrorheological fluid is confined within two circularly extending spaces formed between the opposing inner walls of the heating chamber 7*a* and both faces of the rotor element 17. Thus, when the rotor element 17 rotates, the viscous fluid consisting of the electrorheological fluid confined in the two spaces is subjected to a shearing action as described later.

An outer end of the drive shaft 16 fixedly supports thereon a pulley element 19 which is rotated by an external drive source such as an automobile engine via a belt (not shown). A bolt 18 secures the pulley element 19 to the drive shaft 16. Thus, when the viscous fluid type heating generator is incorporated in a heating system of an automobile, and when the drive shaft 16 is rotationally driven by the automobile engine, the rotor element 17 rotates within the heating chamber 7*a* of the housing assembly of the heat generator.

During the operation of the viscous fluid type heat generator, when warming of a predetermined objective area to be warmed, e.g., a passenger compartment of the automobile, the switch 11 is turned on so as to provide electric connection between the electrodes 8 and 9 and the battery 12. As a result, electric current passes through the electrorheological fluid within the heating chamber 7*a*. Thus, as shown in FIG. 3, in the electrorheological fluid, a disperse phase is brought into lines in a dispersion medium to increase apparent viscosity of the electrorheological fluid.

At this stage, the rotor element 17 is electrically polarized due to an electric potential applied thereto, and therefore, an increase in the viscosity of the electrorheological fluid is not adversely affected by the rotor element 17. Thus, the rotation of the rotor element 17 provides the electrorheological fluid with a shearing action between the non-moving inner walls of the heating chamber 7*a*and the outer faces of the rotor element 17, and accordingly, heat is generated due to shearing of the viscous electrorheological fluid. The heat is transmitted to the heat exchanging liquid circulating through the heat receiving chamber 7*b* by heat exchange between the electrorheological fluid and the heat exchanging liquid via the rear plate 2. Thus, the heat is carried by the heat exchanging liquid toward a heating circuit (not shown) where it is used to warm the predetermined objective area, i.e., the passenger compartment of the automobile.

When the warming of the objective area should be stopped, the switch 11 is turned off so as to stop conduction of the electricity from the battery 12 to the electrodes 8 and 9. Thus, the supply of electric current to the electrorheological fluid is stopped. Therefore, as shown in FIG. 2, the dispersion phase in the electrorheological fluid is released from the aligned condition and dispersed at random in the disperse medium. Accordingly, the apparent viscosity of the electrorheological fluid is reduced, and thus, the rotation of the rotor element 17 does not provide the electrorheological fluid with any heat generative shearing action. Accordingly, no appreciable heat generation occurs, and a supply of heat from the viscous fluid type heat generator to the heating circuit is stopped.

From the foregoing description of the variable heat-generating performance viscous fluid type heat generator according to the embodiment of the present invention, it will be understood that the variable heat-generating performance viscous fluid type heat generator according to the present invention can control heat-generating performance without being provided with an outer heat-generating controller as disclosed in Japanese Unexamined Utility Model Publication (Kokai) No. 3-98107, which functions so as to control the amount of a viscous fluid confined within the heating chamber of the heat generator by adjustably changing the volume of the controlling chamber of the heat-generating controller in response to a change in the requirement of heat generation. Therefore, the viscous fluid type heat generator according to the present invention can be sufficiently reduced in size so as to permit it to be mounted in a body of an automobile.

Further, the heat-generating performance of the viscous fluid type heat generator can be adjustably varied as required by the utilization of the electrorheological fluid of which the apparent viscosity can be easily changed by a simple method such that conduction of electricity to the electrorheological fluid is controlled by provision of a small number of low-cost elements such as the electrodes 8, 9, the electric lead 10, the switch 11 and the battery 12. Therefore, the variable heat-generating performance viscous liquid type heat generator according to the above-described embodiment of the present invention can be manufactured at a low cost.

Figure 4:
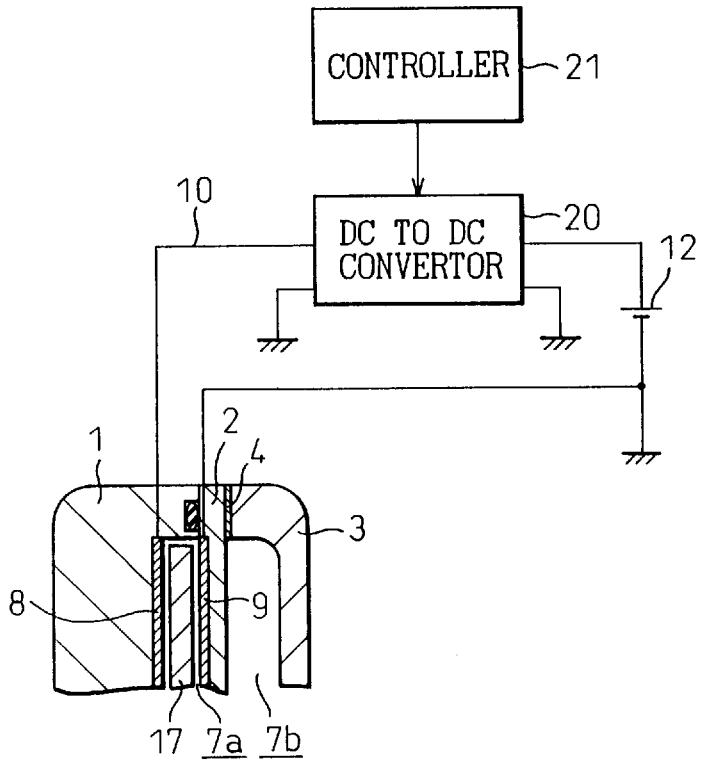
FIG. 4 is a partial cross-sectional view of a variable heat-generating performance viscous fluid type heat generator according to another embodiment of the present invention.

FIG. 4 illustrates a different embodiment of the variable heat-generating performance viscous fluid type heat generator of the present invention. Namely, as obvious from the illustration of FIG. 4, the controllable electricity conducting arrangement employed for controlling the apparent viscosity of the electrorheological fluid of the viscous fluid type heat generator is different from that of the embodiment of FIG. 1.

Referring to FIG. 4, the viscous fluid type heat generator of the present embodiment is different from that of FIG. 1 in that the apparent viscosity of the electrorheological fluid confined in the heating chamber 7*a* is changed by controlling application of the electric field to the electrorheological fluid. Namely, in the viscous fluid type heat generator of FIG. 4, a DC to DC convertor 20 is electro-conductibly interposed between the positive electrode of the battery 12 and the electrode plate 8 of the viscous fluid type heat generator by means of the electric lead 10. The electrode plate 9 of the viscous fluid type heat generator is connected by the electric lead 10 to the negative electrode of the battery 12 and is grounded. The DC to DC convertor 20 is electrically connected to a controller 21. Namely, the controller 21 controls the electric output of the DC to DC convertor 20, i.e., an electric voltage applied from the DC to DC convertor 20 to the electrode plate 8 in response to a change in a requirement for heat-generating performance of the viscous fluid type heat generator. As a result, the electric field applied to the electrorheological fluid by the opposing electrode plates 8 and 9 is adjustably changed to thereby finely control the apparent viscosity of the electrorheological fluid not in an ON-OFF manner but a continuous manner. Therefore, the heat-generating performance of the viscous fluid type heat generator can be continuously and finely controlled as required.

It will be understood that the heat generating and heat exchanging operation of the viscous fluid type heat generator of FIG. 4 is the same as that of the viscous fluid type heat generator of the embodiment of FIG. 1.

However,it should be noted that the present invention is not limited to the two embodiments of FIGS. 1 through 3 and 4. For example, the controllable electricity conducting unit incorporated in the embodiment of FIG. 4 may be replaced with a different type of controllable electricity conducting unit which includes an electric transformer connected to the battery 12 via an inverter, an electric rectifier connected to the output of the transformer, and an electric smoothing circuit.

Further, it should be understood that the controllable electricity conducting unit may be operated by an external control signal such as a signal outputted from a thermometer detecting temperature of the heat exchanging liquid circulating through the heat receiving chamber 7*b* of the viscous fluid type heat generator and the heating circuit, a signal outputted from a thermal sensor detecting a temperature in the passenger compartment of an automobile, and a signal ouputted from a temperature sensor detecting the temperature of the electrorheological fluid confined within the heating chamber 7*a* of the viscous fluid type heating generator.

The pulley 19 mounted on the drive shaft 16 may be replaced with a conventional solenoid clutch which can be electrically controlled by the outer signal controlling the operation of the controllable electricity conducting unit.

In the described viscous fluid type heat generator, the heat exchanging liquid circulating through the heat receiving chamber 7*b* of the heat generator and the external heating circuit may typically be a cooling water for an automobile engine. However. a different kind of fluid such as an appropriate oil may alternatively used as the heat exchanging liquid.

From the foregoing description, it will be understood that many variations and modifications will occur to persons skilled in the art without departing from the scope and spirit of the invention claimed in the accompanying claims.

What we claim:

1. A viscous fluid type heat generator comprising:

a housing assembly defining therein, a heat generating chamber in which heat is generated, and a heat receiving chamber arranged adjacent to said heat generating chamber for permitting a heat exchanging fluid to circulate therethrough to thereby receive heat from said heating chamber;

a drive shaft supported, via a bearing device, by said housing assembly to be rotatable about an axis of rotation thereof;

a rotor element mounted on said drive shaft for rotation together therewith in said heating chamber;

a viscous fluid, filling up a space between an inner surface of said housing assembly defining said heating chamber and an outer surface of said rotor element, for heat generation by the rotation of said rotor element, said viscous fluid being an electrorheological fluid; and a controllable electricity conducting means comprising, stationary, platelike electrode members arranged in the heating chamber to be opposite to one another, for adjustably applying electricity to said electrorheological fluid to thereby adjustably change an apparent viscosity of said electrorheological fluid, said controllable electricity conducting unit being electrically connected to an electric power source.

2. A viscous fluid type heat generator according to claim 1, wherein said electrorheological fluid is a silicone oil forming a dispersion medium suspended therein silicagel as a disperse phase.

3. A viscous fluid type heat generator according to claim 1, wherein said electrorheological fluid is a silicone oil forming a dispersion medium having suspended therein aluminum silicate as a disperse phase.

4. A viscous fluid type heat generator according to claim 1 wherein each of said pair of plate-like electrode members is attached to one of a pair of opposite inner walls of said heating chamber.

5. A viscous fluid type heat generator according to claim 1, wherein said plate-like electrode plate members comprise a pair of annular metallic plates attached to opposite inner faces arranged in said housing assembly.

6. A viscous fluid type heat generator according to claim 1, wherein said controllable electricity conducting means include a switching element operable to turn on and off said electricity applied to said electrorheological fluid within said heating chamber by said electrode members so as to change the apparent viscosity of said electrorheological fluid whereby the heat-generating performance of said viscous fluid type heat generator is changed.

7. A viscous fluid type heat generator according to claim 1, wherein said controllable electricity conducting means includes an electric field changing means operable to change an electric D.C. voltage applied to said plate-like electrode members to thereby change an electric field applied to said electrorheological fluid within said heating chamber.

8. A method of controlling heat-generating performance of a variable heating-performance viscous fluid type heat generator including a housing assembly defining therein, a heating chamber in which heat is generated, and a heat receiving chamber arranged adjacent to the heating chamber for permitting a heat exchanging fluid to circulate therethrough to thereby receive heat from said heating chamber, a drive shaft supported, via a bearing device, by the housing assembly to be rotatable about an axis of rotation thereof; a rotor element mounted on the drive shaft for rotation together therewith in the heating chamber; and a viscous fluid consisting of an electrorheological fluid, and filling up a space between an inner wall of the housing assembly defining the heating chamber and an outer surface of the rotor element, for heat generation by the rotation of the rotor element, the viscous fluid being an electrorheological fluid and arranged to be supplied with a controllable source of electricity from outside the heat generator, wherein the method comprises adjustably changing the electricity applied to said electrorheological fluid through stationary, platelike electrode members arranged in the heating chamber to be opposite to one another by turning on and off the supply of an electric D.C. current to said electrorheological fluid in response to a change in a requirement for heat to be transmitted to the heat exchanging fluid circulating through said heat receiving chamber.

9. A method of controlling heat-generating performance of a variable heat-generating performance viscous fluid type heat generator including a housing assembly defining therein, a heating chamber in which heat is generated, and a heat receiving chamber arranged adjacent to the heating chamber for permitting a heat exchanging fluid to circulate therethrough to thereby receive heat from the heating chamber; a drive shaft supported, via a bearing device, by the housing assembly to be rotatable about an axis of rotation thereof; a rotor element mounted on the drive shaft for rotation together therewith in the heating chamber; and a viscous fluid consisting of an electrorheological fluid, and filling up a space between an inner wall of the housing assembly defining the heating chamber and an outer surface of the rotor element, for heat generation by the rotation of the rotor element, the viscous fluid being an electrorheological fluid and arranged to be supplied with a controllable electricity from outside the heat generator, wherein the method comprises:

adjustably changing the electricity applied to said electrorheological fluid by controlling the intensity of an electric field applied to said electrorheological fluid through stationary platelike electrode members arranaed in the heating chamber to be opposite to one another.

* * * * *